United States Patent [19]

Ikeguchi et al.

[11] 4,056,181

[45] Nov. 1, 1977

[54] SYSTEM AND METHOD FOR DETERMINING VENDIBILITY IN AUTOMATIC VENDING MACHINE

[75] Inventors: Shigehiko Ikeguchi; Norio Yamashita, both of Oora; Eiji Matsuda, Oota, all of Japan

[73] Assignees: Sanyo Electric Co., Ltd.; Tokyo Sanyo Electric Co., Ltd.; Sanyo Vending Machine Co., Ltd., all of Japan

[21] Appl. No.: 667,543

[22] Filed: Mar. 16, 1976

[30] Foreign Application Priority Data

Mar. 17, 1975 Japan ..... 50-32579

[51] Int. Cl.[2] ..... G07F 9/04

[52] U.S. Cl. ..... 194/10

[58] Field of Search ..... 194/10, 2, DIG. 14

[56] References Cited

U.S. PATENT DOCUMENTS

| | | | |
|---|---|---|---|
| 3,190,426 | 6/1965 | Cahill et al. | 194/10 X |
| 3,508,636 | 4/1970 | Shirley | 194/10 |
| 3,754,629 | 8/1973 | Douglass | 194/10 X |

*Primary Examiner*—Stanley H. Tollberg
*Attorney, Agent, or Firm*—Staas & Halsey

[57] ABSTRACT

A system and method for determining vendibility in an automatic vending machine, comprising: a coin sorter, coin detectors for sorted coins, coin reservoirs for sorted coins, empty switches provided to the respective coin reservoirs, said coins comprising three kinds of coins, 100 yen, 50 yen and 10 yen coins, a change pay off mechanism for paying off change using said reserved coins in said reservoirs, commodity price setting means, a counter for counting the number of received 50 yen coins, a counter for counting the number of received 10 yen coins, a signal generator for generating information of the total amount of received coins based on coin detecting signals, a signal generator for generating unit information associated with 10 yen, and a subtractor for sequentially subtracting said unit information from said total amount information, wherein availability of received coins as change is determined at each stage of said sequential subtraction, whereby vendibility for the respective amount at each stage of the sequential subtraction is determined.

15 Claims, 10 Drawing Figures

SYSTEM AND METHOD FOR DETERMINING VENDIBILITY IN AUTOMATIC VENDING MACHINE

BACKGROUND OF THE INVENTION

1. Field of the Invention

The present invention relates to a system for determining vendibility in automatic vending machines. More specifically, the present invention relates to an improvement in such a system for determining vendibility in automatic vending machines wherein coins inserted by a customer are adapted for use as change for enhancement of the rate of operation of the machines.

2. Description of the Prior Art

Various types of automatic vending machines have been put in practical use. Most of such automatic vending machines are adapted to receive a predetermined plurality of kinds of coins and thus are provided with a coin sorter for sorting these received coins. Sorted coins are each transferred along the respective transport paths which are individually connected to the respective reservoir pipes. Such reservoir pipes for the respective sorted coins are each adapted to receive and stock a predetermined number of coins, while an excess number of coins are adapted to be overflowed. Those coins received and stocked in the reservoir pipe are withdrawn by way of payment of change caused by vending or repayment of money commensurate with the amount received, as the case may be. Such a reservoir pipe is provided with a detecting switch for detecting the presence or absence of the coins stocked therein. If and when the coins stocked in the reservoir pipe have run out, a "run out" signal is generated to inform that coins for change have run out.

In the prior art, if and when such a "run out" signal is generated from a change coin dispensing apparatus in the automatic vending machines, the machines were controlled not to receive any more coins for the purpose of automatic vending, whereby further automatic vending was prevented. As a result, the rate of operation of the prior art automatic vending machines was poor.

In order to improve the rate of operation, an approach was adopted wherein in response to such a "run out" signal, the automatic vending machines were controlled to prevent only that kind of automatic vending which requires change, while the machines were left in an "allowed" condition so as to be permitted to perform that kind of automatic vending that does not require any change. According to this approach, it is necessary for the machine to determine whether the amount of inserted coins coincides with the price of the commodity to be vended, so that a reply signal may be generated for repayment of the inserted coins in case of incoincidence. Although this approach has improved the rate of operation of the automatic vending machines to some extent, there is still room for improvement of the rate of the operation. For example, it could happen that, if the inserted coins had been adapted to be used for change, then the commodity could have been vended automatically, depending upon the price of the commodity being vended. Thus, provision of a scheme for determining whether automatic vending is possible for vendibility is found when the inserted coins are adapted to be appropriated for change might enhance the rate of the operation of the automatic vending machines.

SUMMARY OF THE INVENTION

Briefly stated, the present invention comprises a system for determining vendibility in an automatic vending machine, comprising: means for receiving a plurality of kinds of coins, means coupled to said coin receiving means for sorting received coins depending on said kinds of coins, means coupled to said coin sorting means for detecting each of received and sorted coins separately for each kind of coins, means coupled to said coin sorting means for reserving received and sorted coins separately for each kind of coins, means coupled to said coin reserving means for detecting said reserved coins being fewer than a predetermined number of coins separately for each kind of coins, said plurality of kinds of received coins comprising at least three kinds of coins of large, medium and small values, said large and medium values being as large as integral times said small value, means coupled to said coin reserving means for discharging said reserved coins as change from said coin reserving means, means for setting a plurality of pieces of commodities being vended by said machine, means responsive to said medium value coin detecting signal for storing information associated with the number of received coins of said medium value, means responsive to said small value coin detecting signal for storing information associated with the number of received coins of said small value, means responsive to said coin detecting signals for generating information associated with the total amount of received coins, means for generating unit information associated with said small value, means responsive to said total amount associated information generating means and said small value associated unit information generating means effecting sequential subtraction of said small value associated unit information from said total amount associated information, wherein availability as change of received coins is determined for each stage of said sequential subtraction by said subtraction means based on said coin detecting signals of said medium and small values and said information associated with the number of received coins of said medium and small values, whereby vendibility for the respective amount at each stage of the sequential subtraction is determined.

In a preferred embodiment, the said determining means comprises means for counting said small value associated unit information for each stage of said sequential subtraction by said subtraction means, said counting means being a valuable modulo type, which modulo is variable between the integral ratio of said medium value with respect to said small value and the integral ratio of said large value with respect to said small value, means for comparing the count value of said small value associated unit information in said counting means and said information associated with the number of received coins of said small value, and means for controlling said modulo based on said reserved coin detecting signal of said medium value and said information associated with received number of coins of said medium value.

Therefore, a principal object of the present invention is to improve the rate of operation in an automatic vending machine.

Another object of the present invention is to improve the rate of operation in an automatic vending machine by allowing for appropriation as change of coins inserted by a customer.

A further object of the present invention is to improve the rate of operation in an automatic vending machine by allowing for appropriation as change of coins inserted by a customer, wherein a plurality of prices of commodities can be set.

Still a further object of the present invention is to improve the rate of operation in an automatic vending machine by allowing for appropriation as change of coins inserted by a customer, wherein a plurality of coins are acceptable.

An aspect of the present invention is to determine whether the coins inserted by a customer are available as change in an automatic vending machine comprising coin reservoirs for reserving the inserted coins for using reserved coins as change, even if the reservoirs have become empty when the customer starts to operate the machine, thereby to display vendibility and allow for automatic vending, whereby the rate of operation is much more improved.

These and other objects, features, advantages and aspects of the present invention will be better understood when taken in conjunction with the following detailed description of the preferred embodiments made with reference to the accompanying drawings.

DESCRIPTION OF THE PREFERRED EMBODIMENTS

Figure 1:
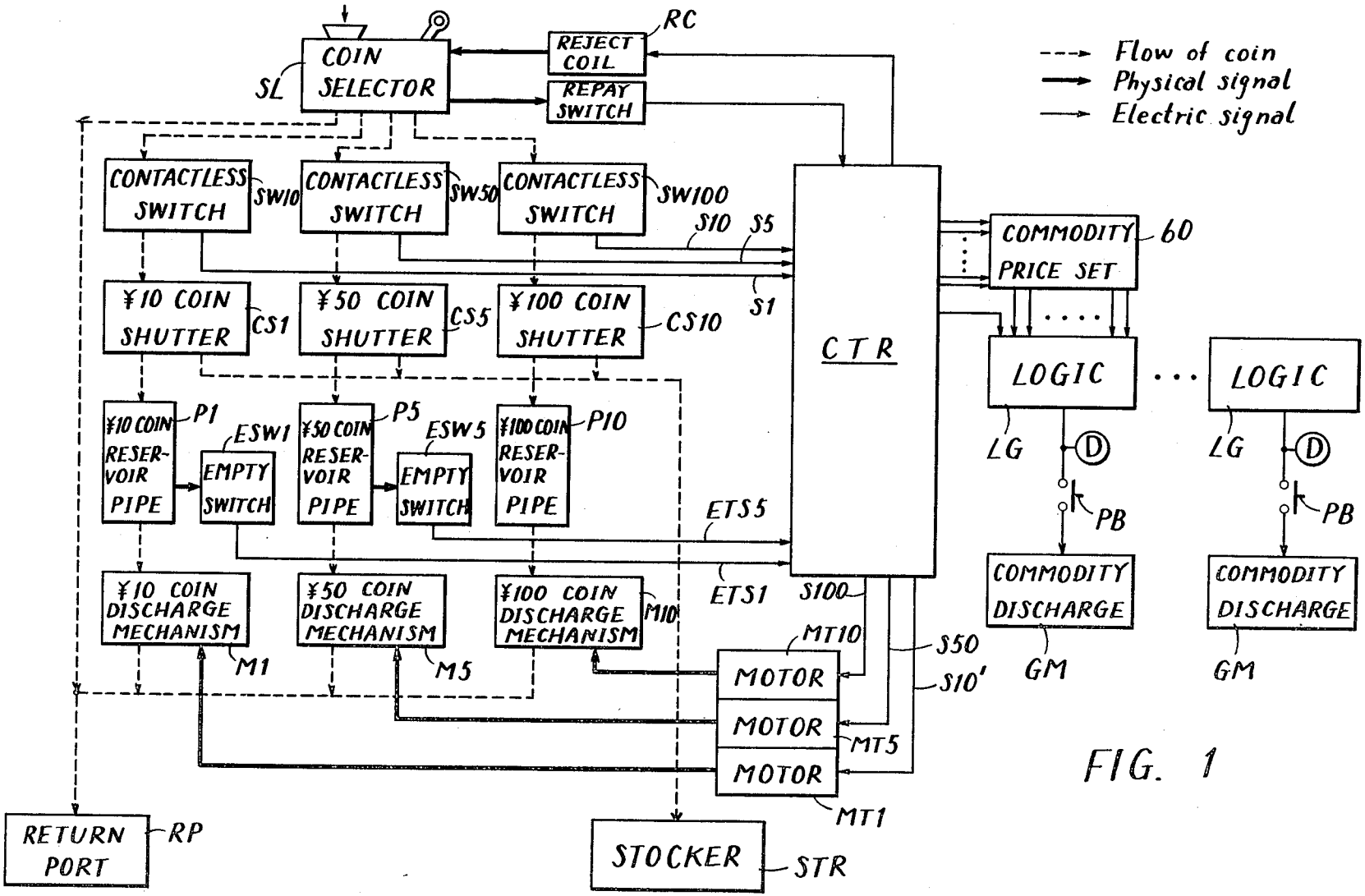
FIG. 1 shows a block diagram of a typical automatic vending machine, which is used to describe an embodiment of the present invention as well as the background of the present invention.

FIG. 1 shows a block diagram of a typical automatic vending machine, which is used to describe an embodiment of the present invention as well as the background of the present invention. As well known, an automatic vending machine comprises a common inlet for insertion of a plurality of kinds of coins. The FIG. 1 embodiment is adapted to receive three kinds of coins, 10 Yen, 50 Yen and 100 Yen coins. The inserted coins are sorted by means of a three-way coin selector SL and the coins thus sorted are separately transported along the respective transport paths. A contactless switch SW10 for detecting passage of 10 Yen coin and a 10 Yen coin shutter CS1 are provided along the tansport path for 10 Yen coins which leads to a 10 Yen coin reservoir pipe P1. If the 10 Yen coin reservoir pipe P1 is filled with a predetermined number, or more, of 10 Yen coins, 10 Yen coins further inserted are diverted by the shutter CS1 to a stocker STR. If the 10 Yen coin reservoir pipe P1 has not been loaded with a predetermined number (preferably 9 in the embodiment), or more, of 10 Yen coins, i.e. if the pipe P1 is empty in accordance with the specific definition in the present specification, an empty switch ESW1 for detecting an empty state of the pipe P1 is turned on to provide an empty signal to a control/operation unit CTR, which constitutes a material portion of the present invention and will be described more fully subsequently. Quite similarly, a contactless switch SW50 and a coin shutter CS5 for 50 Yen coins are provided along a transport path for 50 Yen coins, and are connected to a 50 Yen coin reservoir pipe P5, to which an empty switch ESW5 is operatively coupled.

The switch ESW 5 is adapted to detect the number of coins in the pipe P5 as being a predetermined number (preferably one in the embodiment) or fewer than that. For the same reason as described previously, such a situation is specifically defined as "empty" in the present specification. Similarly, a contactless switch SW100, a coin shutter CS10 and a coin reservoir pipe P10 for 100 Yen coins are provided. Since discharge of change by 100 Yen coins is effected depending upon whether a coin count/storage means, to be described subsequently, stores a count value of 100 Yen coins, it is not necessarily required to provide an empty switch in association with the pipe P10. A 10 Yen coin discharge mechanism M1, 50 Yen coin discharge mechanism M5 and 100 Yen coin discharge mechanism M10 are provided in association with the respective pipes P1, P5 and P10. These discharge mechanisms M1, M5 and M10 are driven by the corresponding discharge drive motors MT1, MT5 and MT10, respectively.

As briefly described previously, the FIG. 1 embodiment comprises the control/operation unit CTR which is typically implemented by a micro processor. The control/operation unit CTR is supplied with detecting signals S1, S5, and S10 provided by the contactless switches SW10, SW50 and SW100, respectively, in response to passage of 10 Yen, 50 Yen and 100 Yen coins, respectively, and also with empty state detecting signals ETS1 and ETS5 provided by the empty switches ESW1 and ESW5, respectively, in response to the empty state of the pipes P1 and P5, respectively. The control/operation unit CTR is responsive to these incoming signals to provide a discharge command signal S10', S50 or S100 for enabling the corresponding discharge drive motor MT1, MT5 or MI10. Accordingly, the corresponding discharge mechanism M1, Ms or M10 is enabled, thereby to discharge necessary coins to a return port RP.

The coin selector SL is provided with a reject coin RC, which is normally allowed to cause the current to flow therethrough by the signal from the control/operation unit CTR, so that a state ready for reception of coins is assumed. If and when coins need to be returned, the flow of current to the coin selector SL is automatically interrupted, whereby the movable member of the reject coil RC drives a stopper to close all the coin transport paths, thereby to cause the return of the coins.

The control/operation unit CTR comprises a system for determining vendibility in accordance with the present invention and will be described in more detail with reference to FIGS. 3 through 8. The output from the control/operation unit CTR is fed to a price setting switch 60 adapted to be set by an operator. The output from the price setting switch 60 and the output from the control/operation unit CTR are transferred to a logic circuit LG a processed, so that a display lamp D can make a display of vendibility in response to the logical processing output. In such a situation, if and when a push button PB is depressed which designates a commodity which is vendible, a commodity discharge mechanism GM is enabled, whereby a desired commodity is discharged.

Figure 2A:
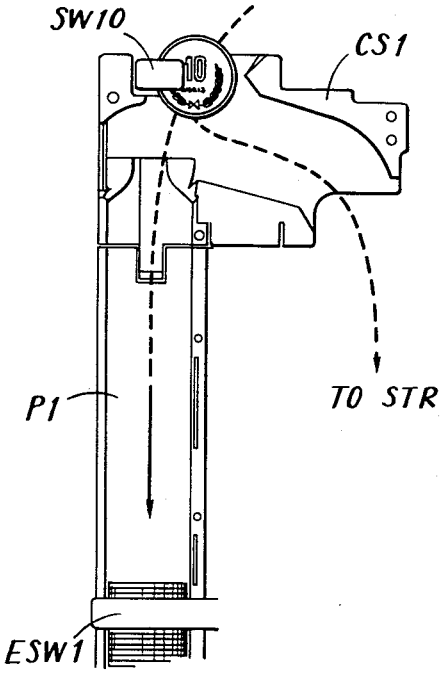
FIG. 2A shows a sectional view of the 10 Yen coin transport path depicted in FIG. 1.

FIG. 2A shows a sectional view of the 10 Yen coin transport path depicted in FIG. 1. The FIG. 2A transport path comprises the 10 yen coin detecting switch SW10, coin shutter CS1, 10 Yen coin reservoir pipe P1 and an empty switch ESW1. A 10 Yen coin inserted and sorted is detected when it passes the contactless switch SW10. The 10 Yen coin is then received by the reservoir pipe P1 and is stocked as change coins. If and when the 10 Yen change coin pipe P1 becomes full with 10 Yen coins, the shutter mechanism CS1 operates to divert the received coins toward the stocker STR.

Figure 2B:
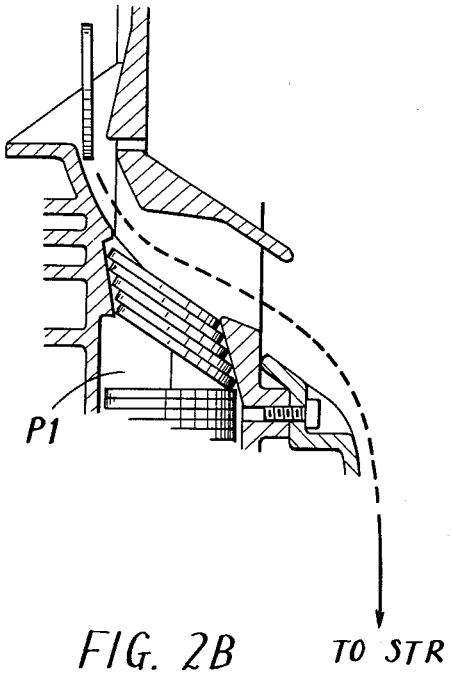
FIG. 2B shows a detailed structure of the shutter mechanism CS1 depicted in FIG. 1.

The detailed structure of the shutter mechanism CS1 is shown in FIG. 2B. Referring to FIG. 2B, the coin shutter mechanism CS1 shown has no movable member and is formed of only a stationary transport path. If and when the coin reservoir pipe P1 becomes full with coins, the inlet to the pipe P1 is automatically closed, thereby to divert the coins received thereafter toward the stocker STR. If the number of coins in the pipe P1 is reduced and the coin closing the inlet to the pipe P1 moves downward, further coins are allowed to be received again by the pipe P1.

Figure 3:
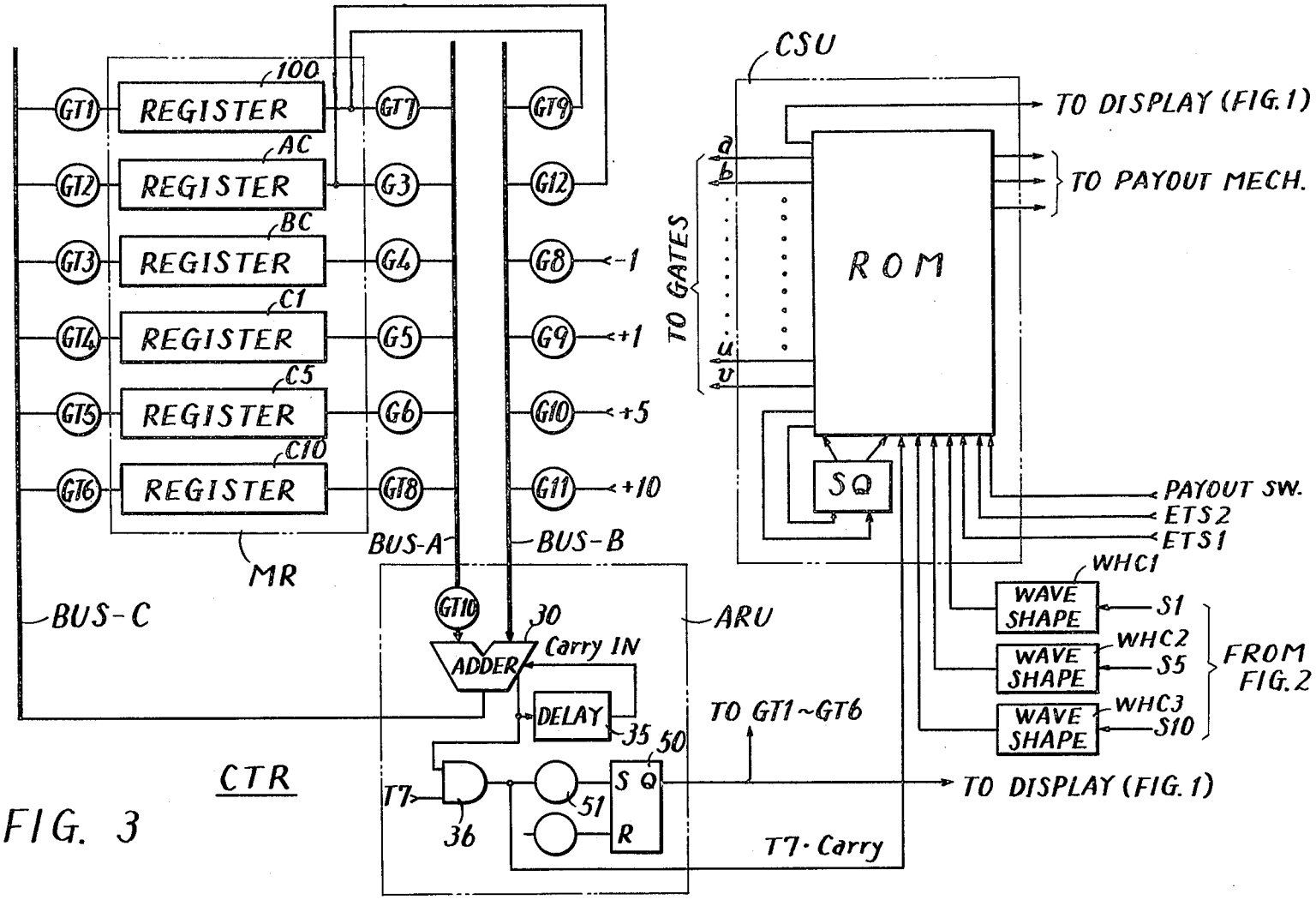
FIG. 3 is a block diagram of only the control/operation unit shown in FIG. 1.

FIG. 3 is a block diagram of only the control/operation unit shown in FIG. 1. In short, the control/operation unit CTR comprises a memory MR, an arithmetic unit ARU and a control storage CSU. The memory MR is aimed to store various information generated at various portions in the vending machine and various information obtained as a result of operation in the machine. In the embodiment shown, the memory MR comprises six 7-bit shift registers 100, AC, BC, C1, C5 and C10. The arithmetic unit ARU can perform various operations, such as addition and addition of a complement of one side input, and detection of a carry from the most significant bit and storage. Although the arithmetic unit ARU is shown having various functions, the detail thereof will be described subsequently. The control storage CSU comprises a read only memory ROM for storing the program of the steps of operation and the steps of controls, and a sequence counter SQ.

The memory MR is connected to the arithmetic unit ARU via buses A and B. The result of operation obtainable from the arithmetic unit ARU is fed via a bus C to the respective registers 100, AC, BC, C1, C5 and C10 of the memory MR. The gates are provided between the respective buses A, B and C and the registers 100, AC, BC, C1, C5 and C10, such that these gates are responsive to the signals from the control storage CSU and from the arithmetic unit ARU to serve to connect the buses and the registers in an appropriate sequence, as to be more fully described subsequently.

Inserted coin detecting signals S1, S5 and S10 obtainable from contactless switches SW10, SW50 and SW100, respectively, are fed through wave shaping circuits WHC1, WHC2 and WHC3, respectively, to the control storage CSU. When the inserted coin detecting signals S1, S5 and S10 are applied to the control storage CSU, the control storage generates in sequence appropriate gate control signals to store information associated with the total amount of inserted coins and the number of inserted coins. The information associated with the amount of inserted coins may be information representative of the total amount per se or another information representing the amount in terms of the number of 10 Yen coins. In the embodiment to be described, the latter mentioned convention has been adopted. The inserted coin amount associated information is stored in the shift register 100. This information can be transferred to other registers under control of relevant gates, as necessary. The registers C1, C5 and C10 are intended to store the number of inserted coins of each kind as sorted. More specifically, the register C1 is adapted to store the number of inserted 10 Yen coins, the register C5 is adapted to store the number of inserted 50 Yen coins, and the register C10 is adapted to store the number of inserted 100 Yen coins. These registers are cleared after one full vending cycle of the automatic vending machine as a result of operation by a customer. One full vending cycle as a result of operation by a customer means a cycle of operation after a customer inserts necessary coins until the customer receives change coins, if any, as well as a commodity, or after a customer inserts necessary coins until the customer receives money repayed in response to his operation for the purpose of repayment.

Now the operation of the FIG. 3 system will be described. When a 10 Yen coin detecting signal S1 is obtained, it is applied to the control storage CSU via the wave shaping circuit WHC1. The control storage CSU makes control to open the gate GT7 connecting the register 100 and the bus A, the gate G9 connecting the bus B and the "add one" (+1) signal source, and the gate GT1 connecting the bus C of the full adder 30 included in arithmetic unit ARU and the register 100, whereby one is added to the contents in the register 100 and the result is stored again in the register 100. The gates G5, G9 and GT4 are further opened, whereby one is added to the contents in the register C1 and the result is stored in the register C1.

When a 50 Yen coin detecting signal S5 is obtained, it is applied to the control storage CSU via the wave shaping circuit WHC2 and the gate control signals for opening the gates GT7, G10 and GT1 are obtained from the control storage CSU. As a result, five is added to the contents in the register 100 and the result thereof is stored again in the register 100. The gates G6, G9 and GT5 are further controlled, whereby one is added to the contents in the register C5 and the result thereof is stored again in the register C5.

When a 100 Yen coin detecting signal S10 is obtained, the gates GT7, G11 and GT1 are opened, whereby ten is added to the contents in the register 100. The gates GT8, G9 and GT6 are further opened and one is added to the contents in the register C10.

The contents in the register 100, originally storing the said information associated with the total amount, are transferred to the register BC, when the gates GT7 and GT3 are opened. The contents in the register BC are withdrawn along the bus A via the gate G4 and added by "−1" (in actuality "127" to be described subsequently) which is withdrawn along the bus B via the gate G8, whereby subtraction of "1" is effected and the result is stored in the register BC along the bus C and via the gate GT3. This subtraction is sequentially repeated until the contents in the register BC become "0".

Figure 4:
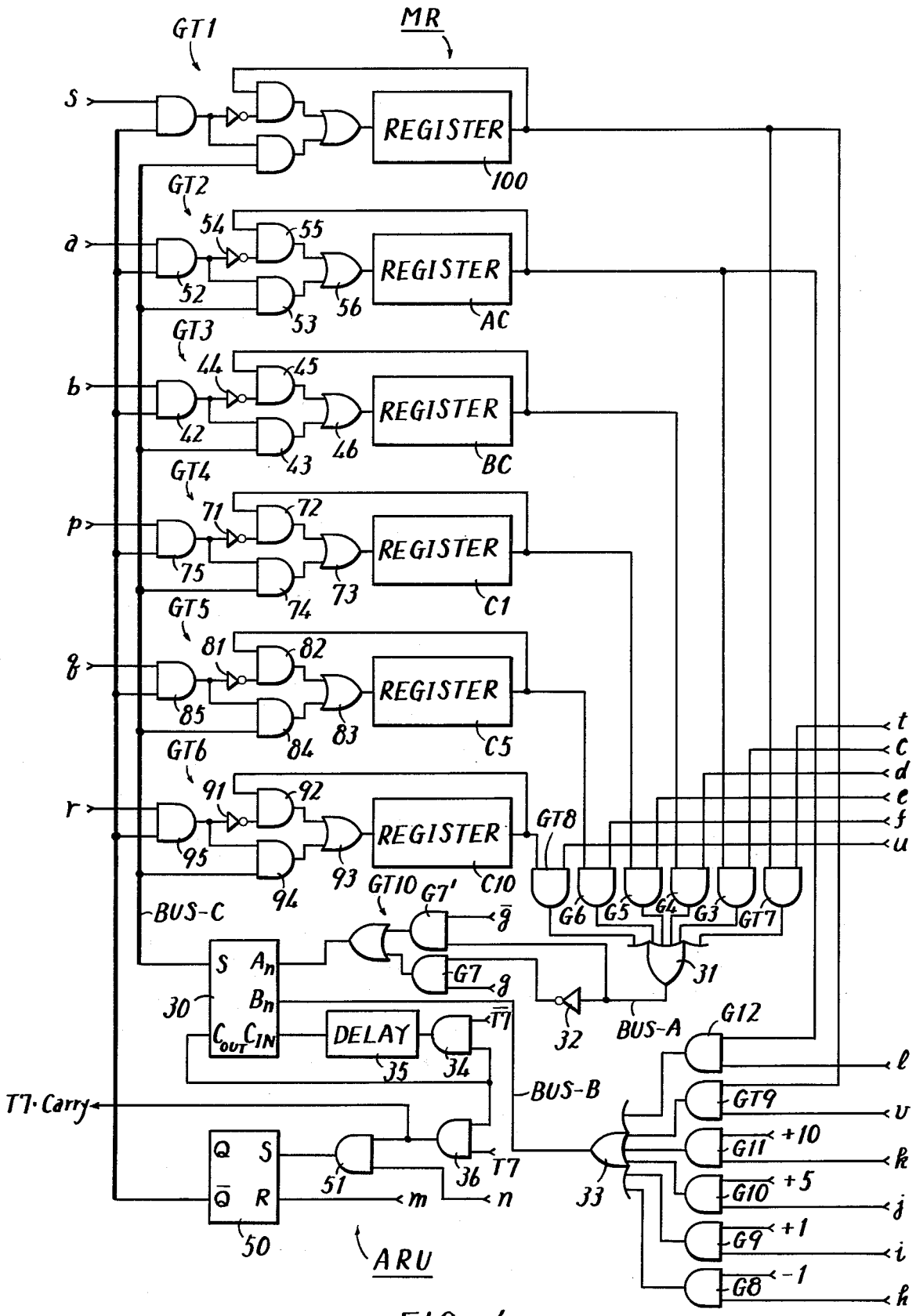
FIG. 4 is a more detailed block diagram of the memory MOR and the arithmetic unit ARU included in the control/operation unit CTR shown in FIG. 1.

FIG. 4 is a more detailed block diagram of the memory MR and the arithmetic unit ARU included in the control/operation unit CTR shown in FIG. 1. As described previously, the unit shown comprises the counters C1, C5 and C10 for separately counting the number of coins of each kind of small, medium and large unit values, respectively, each time a coin is inserted, and for storing the count value. Each of these counters C1, C5 and C10 comprises a 7-bit shift register. It is appreciated that the large and medium values of the coins are an integral number times the small value of the coins. It is pointed out that in the embodiment shown the small, medium, and large unit value coins will be shown and described as being 10 Yen, 50 Yen and 100 Yen coins, respectively. Each of the counters C1, C5 and C10 makes count of each of the detecting signals S1, S5 and S10 obtainable from the inserted coin detecting apparatus, shown as the contactless switches SW10, SW50 and SW100, respectively, in FIG. 1, thereby to store the number of inserted coins of each kind. More specifically, the bus C is connected to the respective counters C1, C5 and C10 through the corresponding AND gates 74, 84 and 94 and the corresponding OR gates 73, 83 and 93, respectively. The other inputs to the AND gates 74, 84 and 94 are connected to the outputs from the AND gates 75, 85 and 95, respectively. The other inputs to the AND gates 75, 85 and 95 are supplied with the control signals p, q and r, respectively. The outputs from the AND gates 75, 85 and 95 are further connected to one input of the AND gates 72, 82 and 92 through the inverters 71, 81 and 91, respectively. The other inputs to the AND gates 72, 82 and 92 are individually coupled to the outputs from the corresponding counters C1, C5 and C10, respectively. From the foregoing description, it is appreciated that whenever the inserted coin detecting signals S1, S5 and S10 are received, the AND gates 72, 82 and 92 are disabled, whereby the detecting signals are counted by the corresponding counters C1, C5 and C10, respectively, whereas if and when the inserted coin detecting signals are not inputted, the AND gates 72, 82 and 92 are enabled, whereby the contents in the counters C1, C5 and C10 are adpated to be recirculated and retained therein. The output from the 10 Yen coin number counter C1 and the output from the 50 Yen coin number counter C5 are applied, through control gates or AND gates G5 and G6, respectively, to an OR gate 31. The control gate G5 is adapted to be opened as a function of a control signal e and the control gate G6 is adapted to be opened as a function of a control signal *f*. These control signals *e* and *f* as well as other control signals associated with other control gates to be described subsequently are adapted to be generated in a predetermined sequence control manner, as to be shown in FIG. 3 and to be more fully described with reference to FIGS. 5 and 6. Since the 100 Yen coin number counter C10 is not directly related with determination of vendibility of the present invention, the output from the counter C10 is not applied to the determination circuit. However, the counter C10 is required, if and when the vendibility is not satisified at all or if and when determination is made whether a 100 Yen coin can be discharged as change. For that purpose the count output from the counter C10 is transferred through a gate GT8 to a bus A.

The FIG. 4 embodiment further comprises a counter AC and a full adder 30 as well as the abovementioned counter BC, for the purpose of determining the vendibility based on the said total amount associated information from the said register 100, 10 Yen coin number information and 50 Yen coin number information. More specifically described, and as previously described, each of the counters AC and BC comprise a 7-bit shift register, which is adapted to be controllable as a function of bit pulses T1, T2, T3, T4, T4, T6 and T7 in synchronism with the counters C1, C5 and C10. The counter AC has been reset to zero at the initial condition and, therefore, information to be written therein is an addition output from the full adder 30. The addition output is applied to the counter AC through the bus C, the AND gate 53 and OR gate 56. The AND gate 53 is enabled as a function of an enabling output from the AND gate 52. One input to the AND gate 52 is coupled to a $\overline{Q}$ output from an RS flip-flop 50 and the other input to the AND gate 52 is connected to a control signal *a*. The control gate G1 is adapted to be opened as a function of a control signal *a*. The output from the AND gate 52 is applied to one input to the AND gate 53, as described previously, and is also applied to one input to an AND gate 55 through an inverter 54. Since the other input to the AND gate 55 is coupled to the output of the counter AC, when the output of the AND gate 52 is high, the contents in the counter AC are recirculated through the AND gate 55 and the OR gate 56 and are retained therein. The gates at the input to the counter BC are also implemented in substantially the same manner as those in the counter AC, except that the other input to the AND gate 42 is connected to a control signal b. The output from the counter AC and the output from the counter BC are fed, through control gates G3 and G4, respectively, to an OR gate 31. The output from the OR gate 31 is fed through a bus A, an invertor 32 and a control gate G7, or through a bus A and a control gate G7′ to an input terminal An of the full adder 30. The control gate G7 is controlled as a function of a control signal *g* and the control gate G7′ is controlled as a function of a control signal $\overline{g}$. In other words, when the control gate G7 is opened, the control gate G7′ is closed, and when the gate G7 is closed, the gate G7′ is opened.

The full adder 30 has input terminals An and Bn, a carry input terminal Cin, an addition output terminal S, and a carry output terminal Cout. The input terminal Bn is connected to an output from a 6-input OR gate 33. The six inputs to the OR gate 33 are connected to control gates G8, G9, G10, G11, G12 and GT9, respectively, which are adapted to be opened as a function of control signals *g, i, j, k, l* and *v*, respectively, thereby to allow a "subtract one" or "−1," signal (represented by a binary number "1111111"), an "add one" or "+1" signal (represented by a binary number "0000001"), an "add five" or "+5" signal (represented by a binary number "0000101"), an "add ten" or "+10" signal (represented by a binary number "0001010"), the output from the counter AC and the output from the register 100, respectively, to pass therethrough. It is pointed out that bit serial processing is effected from the least significant digit of the information. The output from the carry output terminal Cout of the full adder 30 is applied to one input to AND gates 34 and 36. The other input to the AND gate 34 is adapted to receive an inverted output $\overline{T7}$ of the bit pulse T7 and the other input to the AND gate 36 is adapted to receive directly the bit pulse T7. The output T7.Carry from the AND gate 36 is withdrawn as a result of determination of vendibility to be more fully described subsequently. The output from the AND gate 34 is delayed for one bit time period by means of a delay circuit 35 and is applied to the carry input Cin of the full adder 30.

Figure 6:
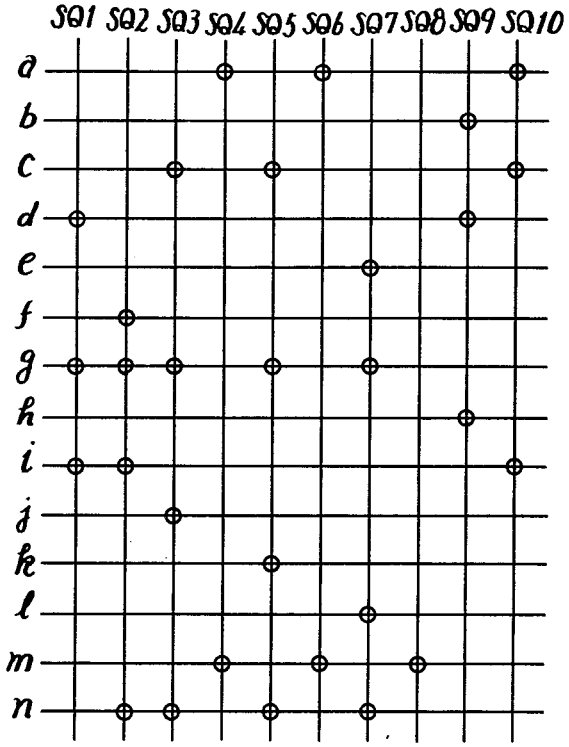
FIG. 6 is a matrix for generation of gate control signals and flip-flop control signals based upon the sequence control signals generated by the sequence control unit shown in FIG. 5.

The RS flip-flop 50 is aimed to control a writing operation of the registers 100, AC, BC, C1, C5 and C10. The set terminal S of the flip-flop 50 is connected to an AND gate 51. One input to the AND gate 51 is connected to receive a control signal *n* generated by a predetermined sequence control signal as shown in FIG. 6 and other input to the gate 51 is supplied with the signal T7. Carry from the AND gate 36. The reset terminal R of the flip-flop 50 is adapted to receive a control signal m generated by the said sequence control signal.

Figure 5:
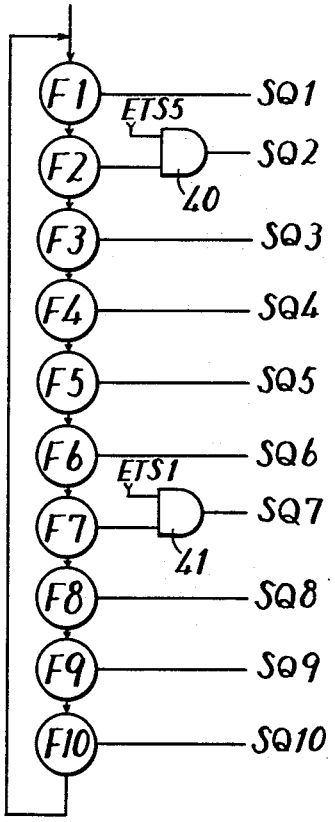
FIG. 5 is a block diagram of a sequence control unit for use in operation of the circuit shown in FIG. 4.

Now, generation of the abovementioned control signals *a, b, c, . . . l, m* and *n* will be described with reference to FIGS. 5 and 6. FIG. 5 is a block diagram of a sequence control unit for use in operation of the circuit shown in FIG. 4 and FIG. 6 is a matrix for generation of the control signals *a, b, c, . . . k* and *l* for gating operation and the control signals m and n for operation of the flip-flop 50 based upon the sequence control signals SQ1, SQ2, . . . SQ9 and SQ10 generated by the sequence control unit shown in FIG. 5. The operation of the circuit shown in FIG. 4, i.e. determination of vendibility is preset by the sequence control as shown in FIG. 5. The sequence control unit shown in FIG. 5 comprises sequence flip-flops F1, F2, . . . F9 and F10 connected in a closed loop fashion, wherein the sequence control signals SQ1, SQ2, . . . SQ9 and SQ10 are withdrawn from the respective flip-flops to make sequence control of predetermined processing. The sequence control signal SQ2 is an ANDed output from an AND gate 40 of the output from the flip-flop F2 and an empty signal ETS5 representative of an empty state of 50 Yen coins in FIG. 1, and similarly, the signal SQ7 is an ANDed output from an ANDed gate 41 of the output from the flip-flop F7 and an empty signal ETS1 representative of an empty state of 10 Yen coins in FIG. 1.

In the matrix shown in FIG. 6, the sequence control signals SQ1, SQ2, . . . SQ9 and SQ10 are fed to column lines, while the gate control signals *a, b, c, . . . k* and *l* and the flip-flop control signals m and n are withdrawn from the row lines. The matrix serves to convert the sequence control signals into the gating and/or flip-flop control signals in the manner preset by provision of interconnecting means as shown in circle marks at the intersections between the column and row lines, as well known to those skilled in the art.

signal S1, S5 or S10 is generated each time a coin is inserted and the number of the inserted coins is counted in the corresponding counter C1, C5 and C10 individually, as previously described in FIG. 3. When all the required coins are inserted, information concerning the number of the respective inserted coins is stored in each of the counters C1, C5 and C10, while information associated with the total amount is generated by the total amount associated information generator 100 based on the inserted coin detecting signals S1, S5 and S10 and, as previously described in FIG. 3, is stored in the counter BC. In such condition, the sequence control further proceeds in accordance with the control unit as shown in FIG. 5.

Figure 8:
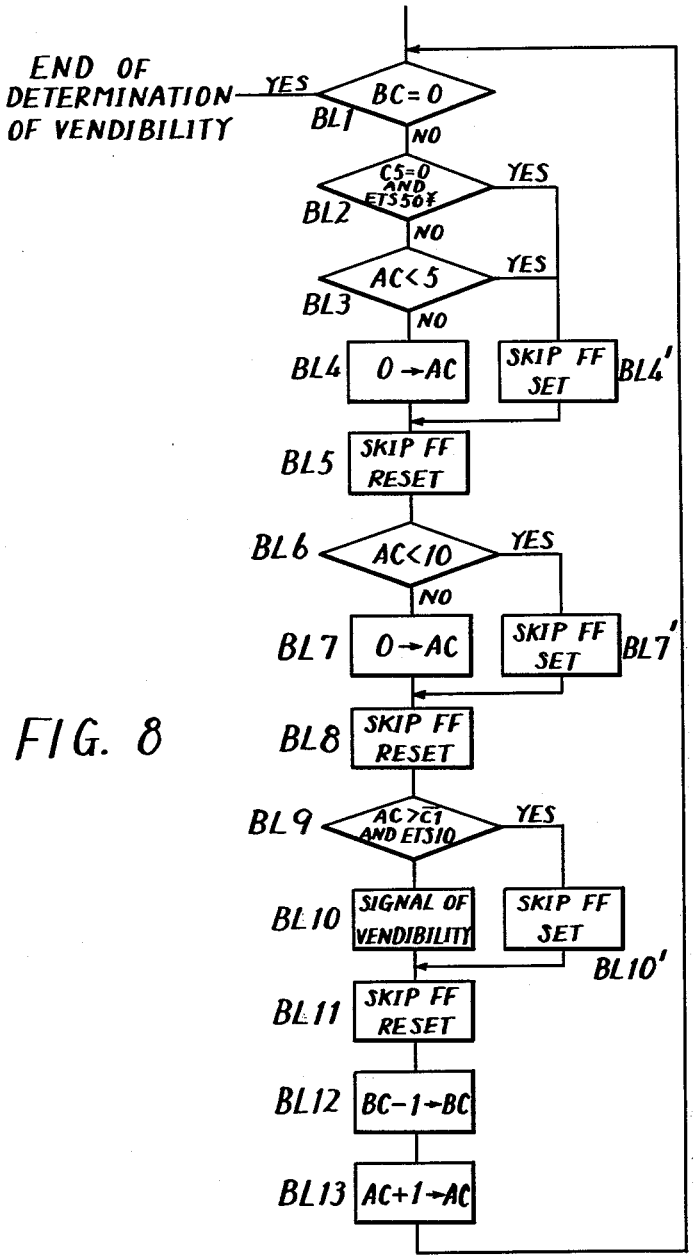
FIG. 8 shows a flow diagram of the operation carried out by the FIGS. 4, 5 and 6 embodiment.

In the condition of sequence stage F1, determination of whether the contents in the counter BC are zero or not is carried out (see block BL1 in FIG. 8). Since determination of vendibility cannot be made if and when the contents in the counter BC are zero, the system has been adapted to be controlled off the sequence in such a situation. Such determination will be described in terms of the operation of the circuit. The gate control signals, *d, g,* and *i* are withdrawn from the matrix shown in FIG. 6 responsive to the sequence control signal SQ1 from the sequence flip-flop F1 to open the control gates G4, G7 and G9, respectively.Accordingly, the inserted coin amount associated information stored in the counter BC (which will be decreased by unit associated information per each recirculation of the sequence, as to be understood subsequently) is withdrawn sequentially at the timing of the bit pulses T1, T2, . . . T7 and is inputted to the input terminals An to the full adder 30 via a path of gate G4 → OR gate 31 → inverter 32 → gate G7, while "+1" (0000001) addition signal is inputted through the gate G9 and the OR gate 33 to the input terminal Bn of the full adder 30. In other words, the said "+1" addition signal is inputted at the timing of the bit pulse T1 which corresponds to the least significant bit. In the embodiment shown, the amount associated information has been adapted to be representative of the amount in terms of the number of 10 Yen coins. Therefore, assuming that the amount of the inserted coins is 100 Yen, the counter BC proves to store "0001010" representative of the decimal value "10". Table 1 shows a truth table of the input terminals An and Bn, the sum output terminal S, the carry output terminal Cout and the carry input terminal Cin of the full adder 30 and the output from the AND gate (T7.Carry) in such a situation.

Table 1

| Bit Pulse | Contents of Counter BC | | | | | | | An | Bn | S | Cout | Cin | T7 . Carry |
|---|---|---|---|---|---|---|---|---|---|---|---|---|---|
| T1 | 0 | 0 | 0 | 1 | 0 | 1 | 0 | 1 | 1 | 0 | 1 | 0 | 0 |
| T2 | 0 | 0 | 0 | 0 | 1 | 0 | 1 | 0 | 0 | 1 | 0 | 1 | 0 |
| T3 | 1 | 0 | 0 | 0 | 0 | 1 | 0 | 1 | 0 | 1 | 0 | 0 | 0 |
| T4 | 0 | 1 | 0 | 0 | 0 | 0 | 1 | 0 | 0 | 0 | 0 | 0 | 0 |
| T5 | 1 | 0 | 1 | 0 | 0 | 0 | 0 | 1 | 0 | 1 | 0 | 0 | 0 |
| T6 | 0 | 1 | 0 | 1 | 0 | 0 | 0 | 1 | 0 | 1 | 0 | 0 | 0 |
| T7 | 0 | 0 | 1 | 0 | 1 | 0 | 0 | 1 | 0 | 1 | 0 | 0 | 0 |

Referring now to FIG. 3, 4, 5 and 6, operation of the system will be described in the following. It is pointed out that such operation has been shown in FIG. 8 in the form of a flow diagram.

First, an initial condition is considered. In that condition, all the counters 100, C1, C5, C10, AC and BC have been reset in response to the discharge of the commodity at the previous vending cycle or the repayment operation of the inserted money amount because of the commodity being not vendible. Assuming that some coins are inserted in that condition, the coin detecting As is well known, the contents in the counter BC implemented by a shift register are recirculated in a bit timing sequence as shown in Table 1. Accordingly, just at the timing of the bit pulse T1, the contents in the counter BC will return to the original positioning in the counter BC or will be positioned from end to end in the order of digits of the original bit arrangement of the information, and in the following bit timing the contents from the lower bit position of counter BC are inputted, through the inverted 32, to the input terminal An of the full adder 30. On the other hand, the input terminal Bn receives the "add one" signal (+1) only at the timing of the bit pulse T1, as described previously. As a result, as seen in the truth table of Table 1, the full adder 30 operates so as to provide the processing result from the sum output terminal S and the carry output terminal Cout.

Now assuming that no coin is inserted, operation is carried out by the full adder in accordance with a truth table shown in Table 2. As understood from comparison of Tables 1 and 2, the carry output terminal Cout from the full adder 30 at the timing of the bit pulse T7 is zero when the amount other than zero is stored in the counter BC and thus the output T7./Carry from the AND gate 36 is zero, while the output T7.Carry from the AND gate 36 is one if and when no inserted amount is stored in the counter BC. More specifically, in the said sequence stage F1, determination is made of the presence or absence of the contents in the counter BC by the logical state of the output T7.Carry, whereby the operation is controlled off the sequence if and when the contents in the counter BC are zero, thereby to complete determination.

said variable modulo of the counter AC is determined by the stage F2 of the sequence. In the stage F2 of the sequence, the sequence control signal SQ2 is withdrawn in response to the fact that the sequence is in the stage F2 and in response to the activation of the empty signal ETS5 (see FIG. 1) representative of 50 Yen coins for change being empty. The sequence control signal SQ2 causes the gating control signals *f, g, i* and the control signal n fed to the AND gate 51 of FIG. 4 to be withdrawn (see FIG. 6). Accordingly, the control gates G6, G7 and G9 are opened, whereby the contents of the counter C5 are withdrawn through the gate G6 on a bit by bit basis in the bit timing sequence and are inputted to the input terminal An of the full adder 30 through the OR gate 31, invertor 32 and the gate G7, while the input terminal Bn of the full adder 30 is supplied with the "add one" signal (+1) through the gate 9 and OR gate 33 at the timing of the bit pulse T1 as in the step F1 of the sequence. Accordingly, in the step F2 of the sequence, determination is made as a function of the output T7.Carry from the AND gate 36 as to whether the contents of the counter C5 are zero or not, i.e. whether 50 Yen coin was inserted or not.

Table 2

| Bit Pulse | Contents of Counter BC | | | | | | | An | Bn | S | Cout | Cin | T7 . Carry |
|---|---|---|---|---|---|---|---|---|---|---|---|---|---|
| T1 | 0 | 0 | 0 | 0 | 0 | 0 | 0 | 1 | 1 | 0 | 1 | 0 | 0 |
| T2 | 0 | 0 | 0 | 0 | 0 | 0 | 0 | 1 | 0 | 0 | 1 | 1 | 0 |
| T3 | 0 | 0 | 0 | 0 | 0 | 0 | 0 | 1 | 0 | 0 | 1 | 1 | 0 |
| T4 | 0 | 0 | 0 | 0 | 0 | 0 | 0 | 1 | 0 | 0 | 1 | 1 | 0 |
| T5 | 0 | 0 | 0 | 0 | 0 | 0 | 0 | 1 | 0 | 0 | 1 | 1 | 0 |
| T6 | 0 | 0 | 0 | 0 | 0 | 0 | 0 | 1 | 0 | 0 | 1 | 1 | 0 |
| T7 | 0 | 0 | 0 | 0 | 0 | 0 | 0 | 1 | 0 | 0 | 1 | 1 | 1 |

The presence or absence of the output T7.Carry will be considered mathematically. Assuming that the contents in the counter BC are B, calculation of the $(1 + \overline{B})$ is carried out by the full adder 30, which may be developed as follows.

$$1 + \overline{B} = 1 + (127 - B) = 128 - B$$

Meanwhile, $$\overline{B} = 127 - B$$

may be explained as follows.

Since B is constituted of 7-bits, $$B = b_6 2^6 + b_5 2^5 + \ldots + b_1 2^1 + b_0 2^0$$

$$= \sum_{i=0}^{6} b_i \cdot 2^i$$

$$\overline{B} = (1 - b_6)2^6 + (1 - b_5)2^5 + \ldots + (1 - b_1)2^1 + (1 - b_0)2^0 = 2^6 + 2^5 + \ldots + 2^1 + 2^0 - (b_6 2^6 + b_5 2^5 + \ldots b_1 2^1 + b_0 2^0) = 127 - B$$

Accordingly, when $B > 0$, i.e. $B \geqq 1$, no carry is obtainable, while when $B = 0$, the result of addition of $(1 + \overline{B})$ becomes 128 to provide a carry.

If and when it is determined that the counter BC has stored the inserted coin amount associated information in the stage F1 of the sequence, the sequence proceeds to the stage F2 by the sequence control shown in FIG. 5. As described previously, the contents of the counter BC are subtraction processed by unit associated information per each recirculation of the sequence, but the counter AC makes addition by a variable modulo in synchronism with subtraction in the counter BC and the In the step F2 of the sequence, the following two cases can be considered. The first case is that the contents of the counter C5 are zero, i.e. 50 Yen coin is not inserted and the 50 Yen coin empty signal ETS5 is presented i.e. no 50 Yen coins have been stored in the reservoir pipe. The second case is the case other than the said first case, i.e. a case where the contents of the counter C5 are zero and the signal ETS5 is absent (50 Yen coins have been stored ), or a case where the contents of the counter C5 are not zero and the signal ETS5 is present, or a case where the contents of the counter C5 is not zero and the signal ETS5 is absent. In the said first case, no 50 Yen coin has been stored nor inserted, and therefore it is not necessary to determine whether 50 Yen coins should be used as change, so that the following stage of the sequence should be followed immediately. In this case, as seen from description of the said stage F1 of the sequence, the output T7.Carry is "1", and the control signal n has been taken, so that the AND gate 51 (see FIG. 4) is enabled, thereby to set the RS flip-flop 50. Therefore, $\overline{Q}$ output from the RS flip-flop 50 becomes zero and the AND gate 52 is disabled and thus the AND gate 53 is disabled, and the AND gate 55 is enabled. As a result, the writing in the counter AC is prevented, while on the contrary the contents of the counter AC are recirculated through the AND gate 55 and OR gate 56 and retained therein. Writing in the counter AC is allowed only if and when the RS flip-flop 50 is reset and the gate GT2 is opened. In the above-mentioned second case, the output T7.Carry is zero and accordingly the AND gate 51 is disabled, whereby the flip-flop 50 is not set, so that when the input to the AND gate 52 of gate GT2 is supplied with $\overline{Q}$ output ("1"), resulting in a condition ready for the writing into the counter AC depending upon the opening of the AND gate 53 whereupon the following stage of the sequence is followed. The stage F2 of the sequence described in the foregoing corresponds to the block BL2 in FIG. 8. As to become apparent subsequently, if and when the RS flip-flop 50 is set, the counter AC becomes a decimal counter, while if and when the flip-flop 50 is reset, the counter AC becomes a quinary counter. The variable modulo number of the counter AC is determined in terms of the integral number of the medium unit (50 Yen) and the large unit (100 Yen) coins with respect to the small unit (10 Yen) coin.

In the stage F3 of the sequence, determination is made whether the contents AC are 5, or 4 or smaller. First, the gating control signals c, g and j and the control signal n are obtained as a function of the sequence control signal SQ3 and accordingly, the gates G3, G7 and G10 are opened and one input to the AND gate 51 is supplied with an enabling signal. Upon opening of the gates G3 and G7, the contents of the counter AC are transferred in a timing sequence to the input terminal An of the full adder 30 through the gate G3, OR gate 31, invertor 32 and the gate G7. upon opening of the G10, the "add five" signal (0000101) is applied in the bit timing sequence to the input terminal Bn of the full adder 30 through the gate G10 and the OR gate 33. Therefore, the full adder 30 makes adding operation based on the abovementioned inputs and the presence or absence of the output T7.Carry from the AND gate 36 is observed based on the result of operation. The full adder 30 makes operation of $(5 + \overline{A})$ where $\overline{A}$ represents an inversion of the contents A in the counter AC. $(5 + \overline{A})$ may be expressed as follows in algebraic description.

$$5 + \overline{A} = 5 + (127 - A) = 128 + (4 - A)$$

Accordingly, if and when $4 - A \geqq 0$, i.e. $A \leqq 4$, a carry is obtained. As understood from the foregoing, if and when the contents of the counter AC are 5, the output T7.Carry is "0", while if and when the contents of the counter AC are $0 \sim 4$, the output T7.Carry is "1". Therefore, if and when the contents of the counter AC are $0 \sim 4$, a logical product is obtainable from the AND gate 51 of FIG. 4 and the RS flip-flop 50 is set, while if and when the contents of the counter AC are 5, the RS flip-flop 50 remains reset, whereupon the following stage of the sequence is followed. The block BL3 in FIG. 8 shows such determination. As described in the foregoing, in the stage F3 of the sequence, if and when it is determined that the 10 Yen coin is inserted and/or stored i.e. a change coin has not run out, detector for 5 is effected for changing the counter AC into a quinary counter.

When the sequence reaches the stage F4, the counter AC is repeatedly reset to zero each time the contents of the counter AC become 5, thereby to make the counter AC operate as a quinary counter. Such an operation is shown as blocks BL4 and BL5 in FIG. 8. First, the gate control signal a and the signal *m* for resetting the RS flip-flop 50 (referred to as "reset signal *m*" hereinafter) are withdrawn as a function of the sequence control signal SQ4 and accordingly the gate GT2 is opened and the flip-flop 50 is reset. Since the flip-flop 50 has been reset since the contents of the counter AC were judged as 5 in the stage F3 of the sequence, the gate GT2 is for the first time opened in the stage F4 of the sequence when the AND gate 52 is enabled. Accordngly, the AND gate 53 is also enabled and the output from the sum output terminals S of the full adder 30 is written into the counter AC through the AND gate 53 and the OR gate 56. At that time, no signal has been applied to the input terminals An and Bn of the full adder 30, so that the output to be withdrawn in a timing sequence from the sum outut terminal S is all 0, with the result that the counter AC is loaded with the value "0", that is, the value "0" is written therein. In other words, the counter AC is reset to zero. Next, in case where the flip-flop 50 was set in the stages F2 and F3 of the sequence, as described previously, the AND gate 52 has closed and any signal has been prevented from being written into the counter AC, so that the counter AC is not reset to zero in the stage F4 of the sequence and the RS flip-flop 50 is reset as a function of the reset signal *m.*

When the sequence reaches the stage F5, determination is made whether the contents of the counter AC are 10 or 9 or smaller (see block BL 6 in FIG. 8). The gate control signals, *c, g* and *k,* and the control signal *n* are withdrawn as a function of the sequence control signal SQ5. The gates G3, G7 and G11 are opened in response to the gate control signals *c, g* and *k* and accordingly the contents of the counter AC are transferred to the input terminal An of the full adder through the gate G3, OR gate 31, invertor 32 and the gate G7, similarly to the case of the stage 3 of the sequence, while the input terminal Bn of the counter AC is supplied in a bit timing sequence with an "add ten" signal (0001010) through the gate G11 and the OR gate 33. The full adder 30 makes an addition operation in accordance with the inputs as set forth in the foregoing, whereby the presence or absence of the output T7.Carry from the AND gate 36 is observed. The full adder makes the operation of $(10 + \overline{A})$ and it may be expressed as follows in an algebraic description.

$$10 + \overline{A} \rightarrow 10 + (127 - A) = 128 + (9 - A)$$

Accordingly, if and when $9 - A \geqq 0$, i.e. $A \leqq 9$, a carry is obtainable. As understood from the foregoing, if and when the contents of the counter AC are 10, the output T7.Carry is "0", while the contents of the counter AC are $0 \sim 9$, the output of T7. Carry is "1". Accordingly, similarly to the case of the step F3 of the sequence, if and when the contents of the counter Ac are $0 \sim 9$, the flip-flop 50 is set, while if and when the contents of the counter AC are 10, the flip-flop 50 remains reset, whereupon the following stage of the sequence is followed. As described in the foregoing, in the stage F5 of the sequence, 10 detection is effected in order to make the counter AC operate as a decimal counter.

When the sequence reaches the stage F6, similarly to the case of the stage F4 of the sequence, the counter AC is reset to 0 if and when the contents of the counter AC are 10, in order to make the counter AC operate as a decimal counter (see block BL7 in FIG. 8). The gate control signal a and the reset signal *m* are withdrawn as a function of the sequence control signal SQ6 and the gate 52 is opened and the flip-flop 50 is reset. Since the flip-flop has been reset since the previous stage F5 of the sequence, if the contents of the counter AC are 10, then, in a manner similar to the case of the stage F4 of the sequence, the counter AC is reset to zero; if the flip-flop 50 has been set in the previous stage F5 of the sequence, the counter AC is not reset to zero at this time and only the flip-flop 50 is reset as a function of the reset signal *m.*

When the sequence comes to the stage F7, determination of vendibility is carried out, which constitutes one of the most essential features of the present invention (see blocks BL9 and BL10 in FIG. 8). In this stage, the sequence control signal SQ7 is withdrawn in response to the fact that the sequence is in the stage F7 and in response to the empty signal ETS1 representative of detection of the state that no 10 Yen coins have been stocked in the reservoir pipe (FIG. 1). The gate control signals *e, g* and *l* and the control signal *n* are withdrawn as a function of the sequence control signal SQ7. The gates G5 and G7 are opened in response to the gate signals *e* and *g*, so that the contents of the counter C1 are fed to the input terminal An of the full adder 30 in the bit timing sequence through the gate G5, OR gate 31, invertor 32 and the gate G7, while the gate G12 is opened responsive to the gate signal *l*, whereby the contents of the counter AC are similarly fed to the input terminal Bn of the full adder 30 in the bit timing sequence through the gate G12 and the OR gate 33. Therefore, the full adder 30 makes operation of ($\overline{C1}$ + A). This equation may be developed as follows.

$$\overline{C1} + A \rightarrow (127 - C1) + A = 128 + (A - C1 - 1)$$

Accordingly, when $A - C1 - 1 \geqq 0$, i.e. $A \geqq C1 + 1$, a carry is obtained. This means that a carry is obtainable, if and when $A > C1$. On the contrary, if and when $A - C1 - 1 < 0$, i.e. $A < C1 + 1$, no carry is obtainable. This means that a carry is not obtainable, if and when $A \leqq C1$. From the foregoing, it is appreciated that the output T7·Carry becomes "1", if and when the contents of the counter AC exceed the contents of the counter C1 and the output T7·Carry is "0" if and when the contents of the counter AC do not exceed, i.e. are the same as or smaller than the contents of the counter C1. Accordingly, in the present stage of the sequence, if and when 10 Yen coins for change have run out and the contents of the counter AC are larger than the contents in the counter C1, 10 Yen coins necessary for change run short and the output T7·Carry of "1" is applied to the AND gate 51 to accomodate the machine to unvendible. Since the AND gate 51 has been supplied with the signal *n*, the gate 51 is enabled and accordingly the flip-flop 50 is set. The set of the flip-flop 50 means prevention of writing into the counter AC. On the other hand, if and when 10 Yen coins for change run short and the contents of the counter AC are the same as or smaller than the contents of the counter C1, then the inserted 10 yen coins may be used as change required in the vending operation and therefore the output T7·• Carry of "0" is applied to the AND gate 51 to make determination of being a chance of vendibility. Accordingly, the AND gate 51 is disabled and the flip-flop 50 is not set or remains reset. If determination is made of being vendible in this stage of the sequence, the contents of the counter BC are transferred to the price setting unit 60 of the vending unit, whereby coincidence thereof with the contents of the counter BC is tested.

Figure 7:
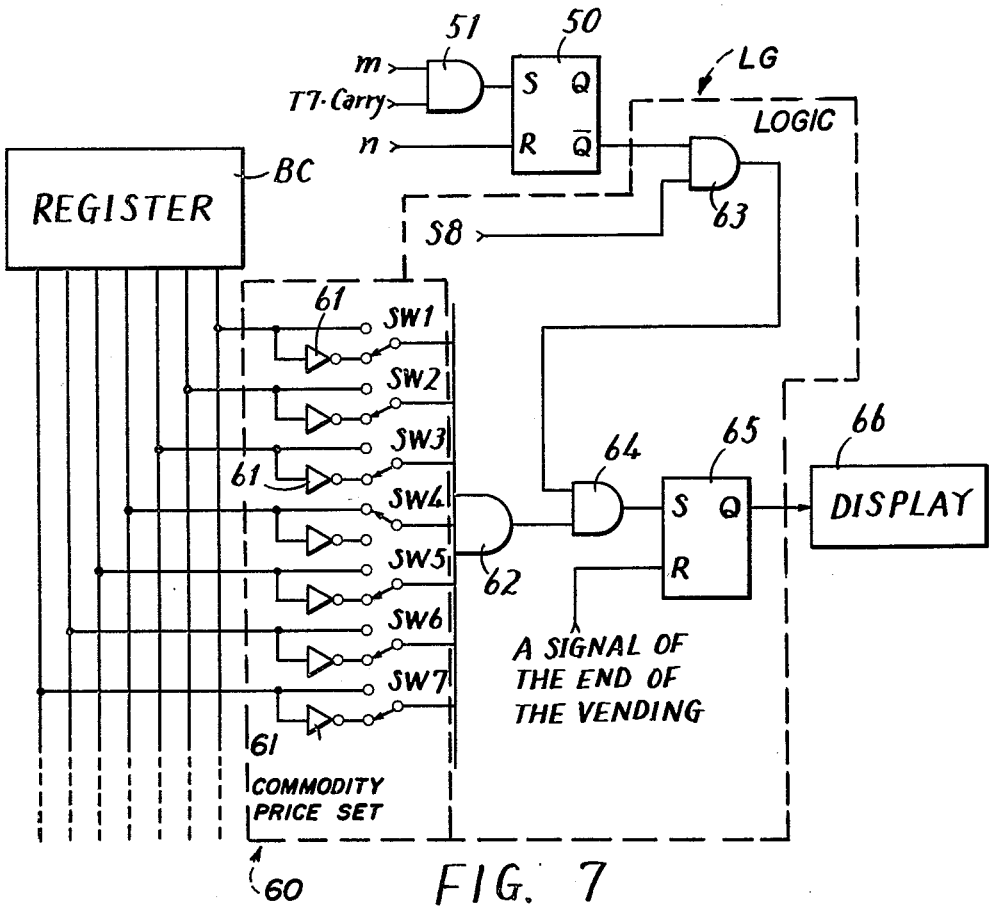
FIG. 7 shows a block diagram of a commodity price setting circuit.

For example, the price setting unit 60 shown in FIG. 7 comprises 7 two-contact switches SW1, SW2 . . . SW7, for the respective bit positions, such that each switch corresponds to each of 7 bits. To contacts of each switch are connected at one side to a transmission line from the corresponding bit of the counter BC and at the other side through an inverter 61. In the embodiment shown, the switches SW1, SW2 . . . SW7 are adapted to correspond to the respective bit of the counter BC from the least significant bit in turn, and setting has been made to "0001000" in terms of a binary member ($2^n$ code), or 8 (80 Yen) in terms of a decimal number. Accordingly, when the contents of the counter BC are 8 commensurate with 80 Yen, a logical product is obtained from the AND gate 62. Since the flip-flop 50 in the unit Aru (in FIG. 4) has been reset, while the sequence control signal SO8 has been obtained, a logical product is also obtained from the AND gate 63 and thus a logical product is obtained from the AND gate 64. Thus, the flip-flop 65 for representing vendibility is set, whereby the output causes the apparatus 66 to make a display of being vendible, thereby to display the amount and the commodity being vendible. This display is maintained until the flip-flop 65 for representing vendible condition is reset as a function of a signal representative of the end of the vending operation.

If the sequence reaches the stage F8, the flip-flop 50 is reset (see block BL11 of FIG. 8). Specifically, the reset signal *m* is withdrawn as a function of the sequence control signal SQ8 and the flip-flop 50 is reset. Since the flip-flop 50 (FIG. 4), has been set in case of being not vendible in the stage F7 of the sequence, i.e. writing into the counters AC and BC has been prevented, the abovementioned resetting of the flip-flop 50 serves to release such condition, thereby to allow for writing in the counters AC and BC in the subsequent stages F9 and F10 of the sequence.

If and when the sequence reaches the stage F9, subtraction by the unit number of the small unit coins, i.e. "1" is effected from the counter BC (see block BL12 of FIG. 8). The sequence control signal SQ9 causes the gate control signals *b, d* and *h* to be generated, whereby the gates GT3, G4 and G8 are opened. As a result the contents of the counter BC are withdrawn in the bit timing sequence and are fed to the input terminal An of the full adder 30 through the gate G4, the OR gate 31 and the gate G7′, while the input terminal Bn is supplied with the subtract one signal (−1) in the bit timing sequence through the gate G8 and the OR gate 33. Accordingly, the full adder 30 makes the operation of (B − 1), where B represents the contents of the counter BC. The equation (B − 1) may be developed as follows.

$$B - 1 = B + 128 - 1 = B + 127$$

Since the value of the B is applied to the input terminal An of the full adder 30, this means that substantially the value "127" i.e. "1111111" (a binary number, including "1" in all bit positions) is fed to the input terminal Bn. Then the result of the previous contents of the counter BC − 1 is obtained from the sum output terminal S of the full adder 30 and is stored in the counter BC through the gate GT3, more specifically, through AND gates 42 and 43, and OR gate 46.

If and when the sequence reaches the stage F10, the unit number of the smallest value coin, i.e. "1" is added to the contents of the counter AC (see block BL13 of FIG. 8). The gate control signals *a, c* and *i* are obtained as a function of the sequence control signal SQ10 and the gates GT2, G3 and G9 are opened. Accordingly, the contents of the counter AC are withdrawn in the bit timing sequence and are fed to the input terminal An of the full adder 30 through the gate G3, the OR gate 31 and the gate G7′, while the abovementioned add one signal (+1) is fed to the input terminal Bn of the full adder through the gate G9 and the OR gate 33. As a result, the result of the previous contents of the counter AC plus one is obtained from the sum output terminal S of the full adder 30 and is stored in the counter AC through the gate GT2, more specifically, through AND gates 52, 53 and OR gate 56. This means that addition of unit number of the smallest value coin is made in the counter AC each time subtraction in the counter BC of the above described stage F9 is made.

After the stage F10 of the sequence is ended, the original stage F1 of the sequence is regained, and each time of one recirculation of the flow of the sequence subtraction by the unit number of the lowest value coin is effected from the contents of the counter BC, so that the abovementioned sequence flow is continued until the contents of the counter BC become zero, whereby determination of vendibility in accordance with the present invention is effected from the information associated with the amount of the inserted coins (represented in terms of the number of the smallest value coins in the foregoing embodiment) for each varying grade of information associated with the amount of the smallest value coin (for each varying number of the smallest value coin in the foregoing embodiment).

An example performed in accordance with the inventive system for determining vendibility in an automatic vending machine will be described. First let it be assumed that the 10 Yen coin and 50 Yen coin for change have run short, and then one 10 Yen coin, one 50 Yen coin and one 100 Yen coin are inserted, which amount to 160 Yen in total. Accordingly, the counters C1 and C5 each store one during a time period for determination as seen in Table 3.

Table 3

| | | | | | | | | | | | | | | | | | |
|---|---|---|---|---|---|---|---|---|---|---|---|---|---|---|---|---|---|
| Counter C1 | 1 | 1 | 1 | 1 | 1 | 1 | 1 | 1 | 1 | 1 | 1 | 1 | 1 | 1 | 1 | 1 | 1 |
| Counter C5 | 1 | 1 | 1 | 1 | 1 | 1 | 1 | 1 | 1 | 1 | 1 | 1 | 1 | 1 | 1 | 1 | 1 |
| Counter AC | 0 | 1 | 2 | 3 | 4 | 0 | 1 | 2 | 3 | 4 | 0 | 1 | 2 | 3 | 4 | 0 | 1 |
| Counter BC | 16 | 15 | 14 | 13 | 12 | 11 | 10 | 9 | 8 | 7 | 6 | 5 | 4 | 3 | 2 | 1 | 0 |
| Display of Vendibility | O | O | X | X | X | O | O | X | X | X | O | O | X | X | X | O | |

Since the amount of the inserting coins is 160 Yen, the counter BC is initially set to 16, as seen in Table 3, and subtraction of one is effected per each recirculation of the sequence until the contents of the counter BC reach zero. Since the counter AC makes counting operation in accordance with either modulo 5 or modulo 10 depending on the abovementioned counter C5 and the 50 Yen coin change running out signal ETS5, and the counter C5 is one in the abovementioned example, counting operation of modulo 5 as shown in Table 3 is effected. Accordingly, determination is made of whether the relation of the counter C1 ≧ the counter AC is established and display of being vendible is made if and when the said relation is satisfied. Since in the foregoing example the counter C1 is one, the subtracted amount in the counter BC when the counter AC is zero and one proves to the amount of being vendible. Thus, as apparent from the Table 3, the amounts of 160 Yen, 150 Yen, 110 Yen, 100 Yen, 60 Yen, 50 Yen and 10 Yen are displayed to indicate that the commodities of these amount are vendible.

If and when only 50 Yen coin has run short as change and no 50 Yen coin has not been inserted, as apparent from the FIG. 8, the counter AC serves to operate as a decimal counter, and since it has been assumed that 10 Yen coins have not run out for change, every amount corresponding to the amount of the inserted coins minus an integral number of 10 Yen proves to be vendible.

Now assuming that only the 10 Yen coin has short for change and no 10 Yen coin has been inserted, the counter AC serves to operate as a quinary counter, as apparent from FIG. 8, and since there is no 10 Yen coin, every amount corresponding to the amount of the inserted coins minus an integral number of 50 Yen proves to be vendible.

As fully described in the foregoing, according to the present invention, skillful use is made of inserted coins as change by the use of the counters C1 and C5, so that even in case where coins for change have run out, every vending amount not exceeding the amount of inserted coins will be selectively adapted to be vendible, thereby to enhance the rate of operation of automatic vending machines.

Another aspect of the present invention is that the counter AC is controlled to be a variable modulo counter based on judgement of the presence or absence of 50 Yen coin of the medium value coin. As a result, determination of vendibility can be advantageous and easily effected only based on the number of the smallest value coins.

Figure 9:
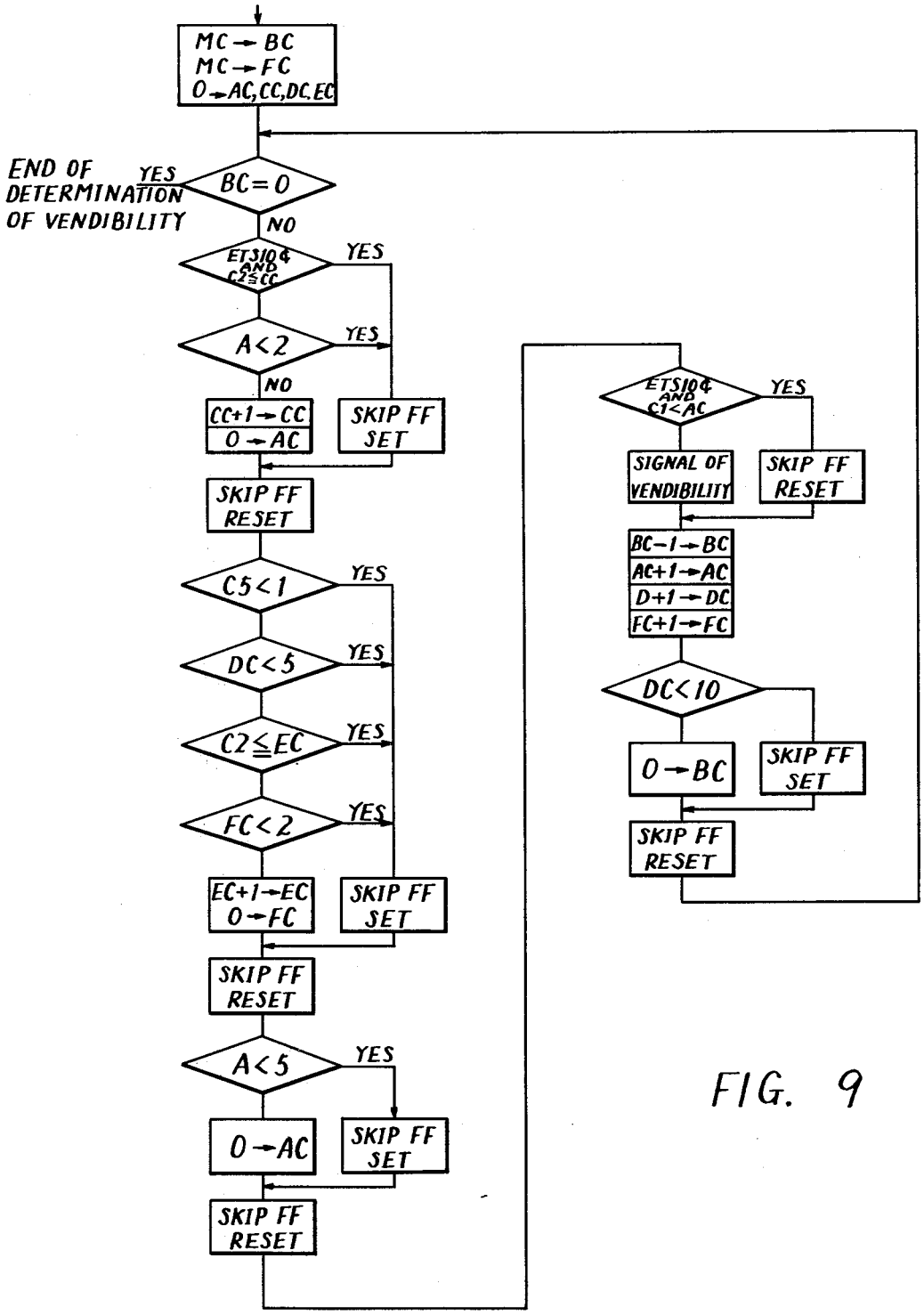
FIG. 9 is a flow diagram of the operation of another embodiment of the present invention.

The foregoing embodiment was shown and described as comprising a three-way selector system for 10 Yen, 50 Yen and 100 Yen coins, wherein the ratio of the large value (100 Yen) to the medium value (50 Yen) to the smallest value (10 Yen) is 10: 5: 1. Thus, it is appreciated that the foregoing embodiment is applicable to an automatic vending machine employing a three-way selector system for 10¢, 5¢ and 1¢ coins in case of the U.S. currency. The principle of the present invention is of course applicable to an automatic vending machine employing a three-way selector system for 25¢, 10¢ and 5¢ coins. In this case, however, a slight modification is necessary to accommodate the system to the ratio of the large value to the medium value to the small value which is 5: 2: 1. Since in this case the ratio of the large value to the medium value is 2.5 and is not an integral number, the least common multiple of these large and medium values, i.e. "50" should be considered, in view of the fact that five 10¢ coins (50¢ in total) are commensurate with two 25¢ coins. Thus, in such a case, further determining steps for considering this fact are necessary. FIG. 9 is a flow diagram of another embodiment of the present invention for accommodating the inventive system to acceptance of 25¢, 10¢ and 5¢ coins in the United States currency. In order to perform the FIG. 9, flow diagram with a block diagram similar to that shown in FIGS. 3 and 4, four additional similar registers are required, as compared with the embodiment shown in FIGS. 3 and 4, and these four additional registers have been denoted as CC, DC, EC and FC, in the FIG. 9 flows diagram.

Although this invention has been described and illustrated in detail, it is to be clearly understood that the same is by way of illustration and example only and is not to be taken by way of limitation, the spirit and scope of this invention being limited only by the terms of the appended claims.

What is claimed is:

1. A system for determining vendibility in an automatic vending machine, comprising:

means for receiving a plurality of kinds of coins, said plurality of kinds of received coins comprising at least three kinds of coins of large, medium and small values, said large and medium values being as large as integral times said small value, means coupled to said coin receiving means for sorting said received coins depending on said kinds of coins, means coupled to said coin sorting means for detecting each of said received and sorted coins separately for each kind of coins, and for generating a small, medium and large value coin detecting signal upon detection of said coins of small, medium and large value, respectively, means coupled to said coin sorting means for reserving received and sorted coins separately for each kind of coins, means coupled to said coin reserving means for detecting when said reserved coins are fewer than a predetermined number of coins separately for each kind of coins, means coupled to said coin reserving means for discharging said reserved coins as change from said coin reserving means, means coupled to said detecting means and responsive to said medium value coin detecting signal for storing information indicating the number of received coins of said medium value, means coupled to said detecting means and responsive to said small value coin detecting signal for storing information indicating the number of received coins of said small value, means coupled to said detecting means and responsive to said small, medium and large value coin detecting signals for generating information indicating the total amount of received coins, means operatively associated with said small value coin information storing means for generating unit information proportional to said small value coin information, subtraction means responsive to said total amount information generating means and said small value unit information generating means for effecting sequential subtraction of said small value unit information from said total amount information, determining means connected to said detecting means and responsive to said coin detecting signals of said medium and small values and connected to said medium and small value coin information storing means and responsive to said information indicating the number of received coins of said medium and small values for determining availability as change of said received coins for each stage of said sequential subtraction by said subtraction means, and having an output for designating vendibility at each stage of said sequential subtraction, means for setting a plurality of prices of commodities being vended by said machines, and display means connected to said determining means and responsive to said vendibility designating output from said determining means and operatively associated with said price setting means for displaying ones among said preset prices of commodities in said price setting means that are vendible.

2. A system for determining vendibility in an automatic vending machine in accordance with claim 1, in which said determining means comprises means for counting said small value unit information for each stage of said sequential subtraction by said subtraction means, and means for comparing the count value of said small value unit information in said counting means and said information indicating the number of received coins of said small value.

3. A system for determining vendibility in an automatic vending machine in accordance with claim 2, in which said counting means is a variable modulo type, which modulo is variable between the integral ratio of said medium value with respect to said small value and the integral ratio of said large value with respect to said small value, and wherein said determining means further comprises means for controlling said modulo of said variable modulo counting means based on said reserved coin detecting signal of said medium value and said information associated with the number of received coins of said medium value.

4. A system for determining vendibility in an automatic vending machine in accordance with claim 1, in which said display means comprises means for detecting coincidence of said vendibility determining outputs from said determining means at the respective stages of said sequential subtraction and said preset prices of commodities in said commodity price setting means, and means responsive to said coincidence output for displaying vendibility.

5. A method for determining vendibility in an automatic vending machine, said method comprising the step of providing an automatic vending machine comprising:

means for receiving a plurality of kinds of coins, means coupled to said coin receiving means for sorting received coins dependent on said kinds of coins, means coupled to said coin sorting means for detecting each of received and sorted coins separately for each kind of coins, means coupled to said coin sorting means for reserving received and sorted coins separately for each kind of coins, means coupled to said coin reserving means for detecting said reserved coins being fewer than a predetermined number of coins separately for each kind of coins, said plurality of kinds of received coins comprising at least three kinds of coins of large, medium and small values, said large and medium values being as large as integral times said small value, means coupled to said coin reserving means for discharging said reserved coins as change from said coin reserving means, and means for setting a plurality of prices of commodities being vended by said machines, said method comprising the further steps of;

generating information associated with the total amount of received coins in response to said received coin detecting signals for each kind, generating information associated with the number of received coins in response to said received coin detecting signals separately for each kind of coins, generating unit information associated with said small value, effecting sequential subtraction of said small value associated unit information from said total amount associated information, determining, at each stage of said sequential subtraction, whether said received coins are available as change, for assumed vending of the corresponding amount at each stage of said sequential subtraction, and withdrawing said result of determination of said availability as change as determination of vendibility.

6. A method for determining vendibility in an automatic vending machine in accordance with claim 5, in which said determining step comprises the steps of cumulatively adding said small value associated unit information for each stage of said sequential subtraction, and comparing the cumulatively added value of said small value associated unit information with said information associated with the number of received coins of said small value.

7. A method for determining vendibility in an automatic vending machine in accordance with claim 6, in which said determining step further comprises the step of controlling the manner of said cumulative addition in said addition step based on said reserved coin detecting signal of said medium value and said information associated with the number of received coins of said medium value, said manner of said cumulative addition being changed between the integral ratio of said medium value with respect to said small value and said large value with respect to said small value.

8. A method for determining vendibility in an automatic vending machine in accordance with claim 5, in which said withdrawing step comprises the step of comparing the result of determination of change availability at each stage of said sequential subtraction and preset prices of commodities in said commodity price setting means.

9. A control system for determining, based on an amount of money inserted into an automatic vending machine and available change on hand in said machine, the vendibility of various respective commodities for each of a plurality of possible selections of said various respective commodities, said machine including at least a receiving means for receiving a plurality of coins of various types, and having an output for producing a coin type detection signal unique to each of said various types for each of said plurality of coins received; and a change holding means for each given type of said various types of coins for holding said plurality of coins of said given type, and having an output for producing an empty-signal indicating when said plurality of coins of said given type on hand for change is less than a predetermined number; said control system comprising, in combination;

commodity price setting means for indicating the respective prices of the various respective commodities being vended; and control means coupled to said receiving means and said change holding means for receiving and analyzing said unique coin type detection signals and said empty-signals, respectively, therefrom, so as to determine said amount of money inserted and said available change on hand, respectively, said control means being operatively associated with said price setting means for comparing said amount of money inserted with the respective prices of the various respective commodities being vended to determine, for each of said plurality of possible selections, respective amounts of change which must be made, said control means further comparing said respective amounts of change which must be made for each of said plurality of possible selections with said available change on hand so as to produce control signals indicating which of said commodities are vendible based on said amount of money inserted and the available change on hand in said machine.

10. A control system for determining vendibility as recited in claim 9 wherein said commodity price setting means includes a plurality of switches manually settable to indicate the price of each commodity, and wherein said control means includes:

control circuit means connected to said price setting means for providing thereto a sequence of signals each signal representing the corresponding price of a commodity which may be purchased with said plurality of coins received given said various types of coins available in said changing holding means; and logic means connected to said control circuit means and operatively associated with said price setting means for successively providing, for each signal of said sequence, an indication of identity between said corresponding price and said respective prices indicated by said price setting means.

11. A control system for determining vendibility as recited in claim 10 including display means, one for each respective commodity, connected to said logic means and responsive to said indication of identity therefrom for displaying the vendibility of said respective commodity.

12. A control system for determining vendibility as recited in claim 9, wherein said control means includes:

memory means having an input for receiving said unique coin type detection signals, and for holding information relative to said plurality of coins received;

arithmetic means coupled to said memory means and operatively associated therewith for performing various given arithmetic operations on said information in said memory means; and control storage unit means connected to said arithmetic means and having an input for receiving at least said empty signals, and responsive thereto for issuing control signals to said arithmetic means, whereby to designate said given arithmetic operations which are to be performed.

13. A control system for determining vendibility as recited in claim 12, wherein said control storage unit means is a read-only memory.

14. A control system for determining vendibility as recited in claim 12, wherein said memory means is a plurality of registers, each for holding information relative to the total value of said plurality of coins received and the number of coins of each type received, respectively.

15. A method of determining vendibility of various commodities having various commodity prices in a vending machine which receives a plurality of coins of different types ranging from small value to large value, the method comprising the steps of:

a. detecting coins of various types from the plurality of coins received;

b. generating information relative to the total amount, and individual amounts by type, of coins received, as well as unit information corresponding to the value of the small value type coins received;

c. successively subtracting an amount equal to increasing multiples of said unit information from said total amount information to obtain successive remainders;

d. during step (c), evaluating at each stage of subtraction a change necessary for each successive subtracted amount, and determining based on said evaluated change whether the change can be paid out from the plurality of coins on hand in said machine,;

e. indicating each said successive remainder for which the change can be paid out, whereby to indicate each commodity price for which change can be made; and f. indicating as vendible those commodities having commodity prices for which change can be made.

* * * * *

UNITED STATES PATENT OFFICE

CERTIFICATE OF CORRECTION

Patent No. 4,056,181 Dated November 1, 1977

Inventor(s) Shigehiko Ikeguchi et al

It is certified that error appears in the above-identified patent and that said Letters Patent are hereby corrected as shown below:

Column 1, line 65, "for" should be --or--.
Column 2, line 22, "pieces" should be --prices--.
Column 3, line 67, "tansport" should be --transport--.
Column 4, line 51, "MI10" should be --MT10--.
Column 4, line 52, "Ms" should be --M5--.
Column 4, line 55, "coin" should be --coil--.
Column 5, line 4, "a" (first occurrence) should be --and are logically--.
Column 5, line 13, "yen" should be --Yen--.
Column 5, line 68, after "storage" insert --CSU--.
Column 8, line 6, "T4" (second occurrence) should be --T5--.
Column 8, line 43, "S" should be --S'--.
Column 8, line 45, after "an" insert --A--.
Column 8, line 49, "g" should be --h--.
Column 8, line 65, "T7.Carry" should be --T7·Carry--.
Column 9, line 10, "T7.Carry" should be --T7·Carry--.
Column 10, line 26, "respectively.Accordingly" should be --respectively. Accordingly--.
Column 10, line 48, "(T7.Carry)" should be --(T7·Carry)--.
Table 1, "T7.Carry" should be --T7·Carry--.
Column 11, line 14, "T7.Carry" should be --T7·Carry--.
Column 11, line 15, "T7.Carry" should be --T7·Carry--.
Column 11, line 20, "T7.Carry" should be --T7·Carry--.
Table 2, "T7.Carry" should be --T7·Carry--.
Column 11, line 34, "T7.Carry" should be --T7·Carry--.
Column 11, line 55, "+ ..." should be --+ ... +--.
Column 12, line 21, "T7.Carry" should be --T7·Carry--.
Column 12, line 51, "T7.Carry" should be --T7·Carry--.
Column 12, line 63, "T7.Carry" should be --T7·Carry--.

UNITED STATES PATENT OFFICE

CERTIFICATE OF CORRECTION

Patent No. 4,056,181 Dated November 1, 1977

Inventor(s) Shigehiko Ikeguchi et al.

It is certified that error appears in the above-identified patent and that said Letters Patent are hereby corrected as shown below:

Column 13, line 22, "upon" should be --Upon--.
Column 13, line 22, after "the" (second occurrence) insert --gate--.
Column 13, line 28, "T7.Carry" should be --T7·Carry--.
Column 13, line 39, "T7.Carry" should be --T7·Carry--.
Column 13, line 40, "T7.Carry" should be --T7·Carry--.
Column 14, line 10, after "has" insert --been--.
Column 14, line 32, "T7.Carry" should be --T7·Carry--.
Column 14, line 41, "T7.Carry" should be --T7·Carry--.
Column 14, line 42, "T7.Carry" should be --T7·Carry--.
Column 15, line 51, "T7.• " should be --T7·--.
Column 15, line 63, "To" should be --Two--.
Column 16, line 8, "SO8" should be --SQ8--.
Column 18, line 66, "flows" should be --flow--.

Signed and Sealed this

*Eighteenth* Day of *April 1978*

[SEAL]

*Attest:*

RUTH C. MASON
*Attesting Officer*

LUTRELLE F. PARKER
*Acting Commissioner of Patents and Trademarks*